US005102014A

United States Patent [19]

Yanagisawa et al.

[11] Patent Number: 5,102,014

[45] Date of Patent: Apr. 7, 1992

[54] TUBE SQUEEZER

[75] Inventors: Hiromi Yanagisawa; Seishi Yahata, both of Tokyo, Japan

[73] Assignee: Nihon Kohden Corporation, Japan

[21] Appl. No.: 522,028

[22] Filed: May 11, 1990

[30] Foreign Application Priority Data

May 12, 1989 [JP] Japan ..... 1-55161[U]

[51] Int. Cl.[5] ..... B65D 35/34

[52] U.S. Cl. ..... 222/100; 222/99

[58] Field of Search ..... 222/95, 99, 100, 214

[56] References Cited

U.S. PATENT DOCUMENTS 4,570,828 2/1986 Wood ..... 222/100

4,576,314 3/1986 Elias et al. ..... 222/99

FOREIGN PATENT DOCUMENTS 589176 12/1959 Canada ..... 222/99

1509072 11/1966 France ..... 222/99

*Primary Examiner*—Michael S. Huppert

*Assistant Examiner*—Joseph A. Kaufman

[57] ABSTRACT

A tube squeezer is disclosed wherein a lower end portion of a tube is wound on a winding shaft so as to squeeze out the contents of the tube. The slit extends along an axis of the inner cylinder. An outer cylinder is rotatably fitted on an outer periphery of the inner cylinder. The outer cylinder has an open portion for receiving the closed end portion of the tube, and the open portion extends along an axis of the outer cylinder. A disc-shaped plate is fixedly mounted on one end of said inner cylinder in coaxial relation thereto. The disc-shaped plate has a projection-and-groove portion formed at its outer periphery. The projection-and-groove portion has alternate projections and grooves arranged radially. A lock lever is supported at one end on an outer periphery of the outer cylinder. The lock lever is engageable at the other end thereof with the projection-and-groove portion.

5 Claims, 2 Drawing Sheets

TUBE SQUEEZER

BACKGROUND OF THE INVENTION

This invention relates to a tube squeezer in which a closed end of a tube is wound on a winding shaft so as to squeeze out the contents of the tube.

FIG. 3(*a*) shows a conventional tube squeezer in which a closed end of a tube, filled with contents such as a paste, is wound on a winding shaft so as to fully squeeze the paste out of an open portion of the tube. More specifically, a slit 2 is axially formed in the outer periphery of the winding shaft 1, and the lower end 4 of the tube 3 is inserted into the slit 2. The tube 3 is grasped, and a handle 5 connected to one end of the winding shaft 1 is rotated to wind the tube 3 around the winding shaft 1, thereby squeezing the contents of the tube 3 out of its upper open portion 6.

However, in the conventional tube squeezer of the above construction, if the hand holding the tube 3 is moved off the tube when a large amount of the paste (contents) is squeezed from the tube, the winding of the tube 3 is located as shown in FIG. 3(*b*). Therefore, for squeezing the tube 3 again, the winding shaft 1 must be rotated again by a certain amount corresponding to the loosening. This problem can be overcome by providing a lock mechanism for locking the wound tube 3 relative to the winding shaft 1. However, conventional lock mechanisms have been found disadvantageous in that a locking force is weak, and that such lock mechanism is less practical because the pitch of a locking angle is too large.

As described above, the conventional tube squeezer suffers from the problem that if the hand is moved off the tube when winding the tube on the winding shaft, the winding of the tube is loosened. Further, even in the conventional construction provided with the lock mechanism for locking the tube relative to the winding shaft, the locking force is weak, and also is less practical because the pitch of the locking angle is too large.

SUMMARY OF THE INVENTION

With the above deficiencies of the prior art in view, it is an object of this invention to provide a tube squeezer which can firmly lock the wound tube, and can improve the operability by reducing the pitch of the locking position.

This and other objects have been achieved by a tube squeezer wherein a closed end portion of a tube is wound on a winding shaft so as to squeeze out contents of the tube, comprising an inner cylinder having a slit for retaining the closed end of the tube, the slit extending along an axis of the inner cylinder; an outer member rotatably fitted on an outer periphery of the inner cylinder, the outer member having an open portion for receiving the closed end portion of the tube, and the open portion extending along an axis of the outer member; and an engagement retaining means for retaining an engagement between the inner cylinder and the outer member without any displacement therebetween in a rotational direction when the closed end of the tube is retained by the inner cylinder.

With the above construction, the lower end of the tube is passed via the open portion of the outer cylinder, and is retained in the slit formed in the inner cylinder. Then, the outer cylinder is grasped, and the disc-shaped plate fixedly mounted on the inner cylinder is rotated so as to wind the tube on the outer periphery of the inner cylinder. By pressing the lock lever so as to engage its distal end with the projection-and-groove portion, the inner cylinder can be firmly locked relative to the outer cylinder, with the tube wound around the inner cylinder. Further, by reducing the pitch of the projection-and-groove portion, the locking can be made at an arbitrarily-selected position.

DESCRIPTION OF THE PREFERRED EMBODIMENTS

The invention will now be described with reference to to the drawings.

Figure 1:
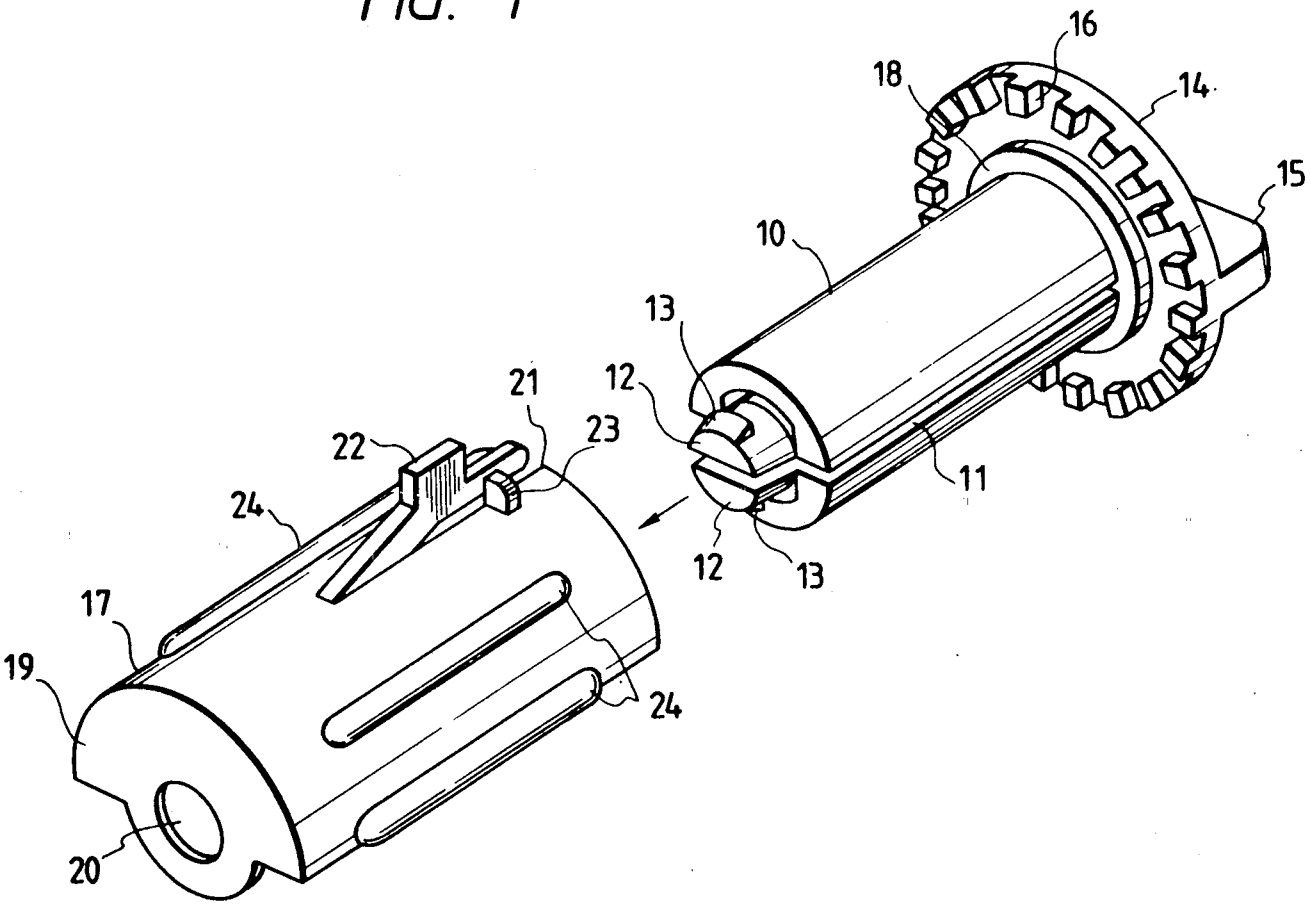
FIG. 1 is an exploded, perspective view of a tube squeezer provided in accordance with the present invention.

In FIG. 1, a slit 11 is formed axially in an inner cylinder or tube 10 in a diametrical plane thereof except for its proximal end portion. A pair of opposed hooks 12 are received in the inner cylinder 10 at a central portion thereof. An outwardly-projecting pawl 13 is formed on the distal end of each of the hooks 12. A disc-shaped plate 14 greater in diameter than the inner cylinder 10 is fixedly mounted on the proximal end of the inner cylinder 10 in coaxial relation thereto, and is disposed perpendicular to the axis of the inner cylinder 10. The proximal ends of the hooks 12 are connected to the disc plated 14. The hooks 12 are flexible. A handgrip 15 is mounted diametrically on the outer side or face of the disc plate 14, and a radial projection-and-groove portion 16 is provided on the inner side of the disc plate 14 along the outer periphery thereof, the alternate radial projections and grooves being arranged at a predetermined pitch. A step portion 18 is provided between the inner cylinder 10, disposed inwardly of the disc plate 14, and the projection-and-groove portion 16 in coaxial relation thereto. An outer cylinder 17 later described is slidably guided by the step portion 18.

The outer cylinder 17 has a generally semi-circular cross-section, and an end plate 19 is fixedly secured to one end of the outer cylinder 17 and is disposed perpendicular thereto. A hole 20 is formed through a central portion of the end plate 19. When the inner cylinder 10 is inserted into the outer cylinder 17, the hooks 12 in the inner cylinder 10 are flexed, so that the pawls 13 are rotatably retained in the hole 20. At this time, the end of the outer cylinder 17 remote from the end plate 19 is fitted on the step portion 18 formed on the disc plate 14 in a manner to allow a relative rotation therebetween. A notch 21 is formed axially in the outer periphery of the outer cylinder 17. A lock lever 22 is resiliently intergrally connected at one end to that portion of the outer cylinder 17 adjacent to one end of the notch 21 close to the end plate 19. When the inner cylinder 10 is inserted into the outer cylinder 17, the other end of the lock lever 22 is engaged in the projection-and-groove portion 16. A guide piece 23 serves to guide the movement of the lock lever 22, and a plurality of reinforcement ribs 24 for reinforcing the outer cylinder 17 are formed on the outer peripheral surface of the outer cylinder and extend along the axis thereof in parallel relation to one another.

Figure 2:
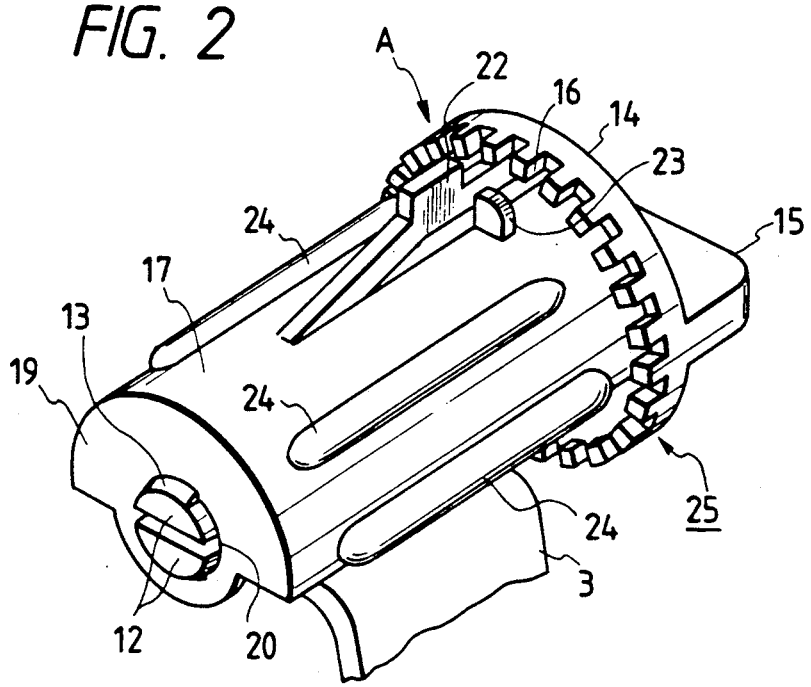
FIG. 2 is a perspective view of the tube squeezer in its assembled condition.
Figure 3A:
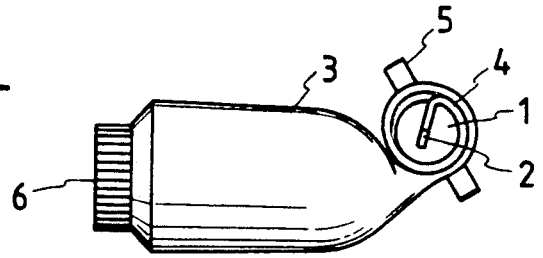
FIG. 3(a) PRIOR ART
FIG. 3A–3B are side-elevational views of a conventional tube squeezer.
Figure 3B:
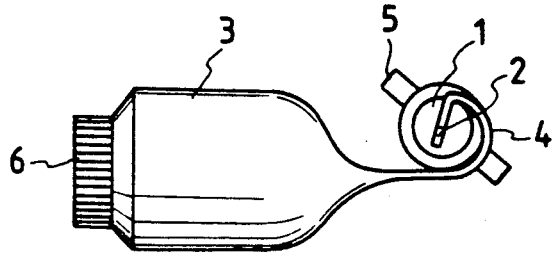
FIG. 3(b) PRIOR ART

The operation of this embodiment will now be described. In the tube squeezer 25 in which the inner cylinder 10 is rotatably received in the outer cylinder 17 as shown in FIG. 2, the outer cylinder 17 is rotated relative to the inner cylinder 10 to expose the slit 11, and the closed end of the tube 3 is inserted into an retained in the slit 11. Then, the outer cylinder 17 is grasped, and the inner cylinder 10 is rotated by the handgrip 15, so that the tube 3 is introduced into a space between the inner cylinder 10 and the outer cylinder 17 and is wound on the outer periphery of the inner cylinder 10. In this manner, the contents of the tube 3 are squeezed out of the open end of the tube 3. During the rotation of the inner cylinder 10, the lock lever 22 is kept in an outwardly projected condition because of its resilient nature, and is not engaged with the projection-and-groove portion 16. When it is desired to effect the locking during the squeezing of the tube 3, the lock lever 22 is pressed in a direction of an arrow A so as to engage the distal end of the lock lever 22 with the projection-and-groove portion 16, thus achieving the locking.

In this embodiment, in a condition in which the tube 3 is wound on the inner cylinder 10, a firm locking can be achieved by the lock lever 22, and besides by reducing the pitch of the projection-and-groove portion 16, the locking can be made at an arbitrarily-selected position.

In the above embodiment, although the cross-section of the outer cylinder 17, as well as the cross-section of the open portion of the outer cylinder 17, is semi-circular (crescent-shaped), the position and shape of the portion are not restricted to the illustrated example. For example, the outer cylinder 17 may be of a cylindrical shaped in which case an open portion is formed in the outer cylinder along the axis thereof.

As described above, in the present invention, the tube squeezer comprises the inner cylinder and the outer cylinder, and a relative rotation between the two is prevented by the lock lever. With this construction, the tube can be firmly locked when squeezing out the contents of the tube, and besides and arbitrary locking position can be selected.

What is claimed is:

1. A tube squeezer wherein a closed end portion of a tube is wound on a winding shaft so as to squeeze out contents of said tube, said tuber squeezer comprising:

an inner cylinder having a slit for retaining the closed end portion of said tube, said slit extending along an axis of said inner cylinder;

an outer member rotatably fitted on an outer periphery of said inner cylinder, said outer member having an opening portion for receiving the closed end portion of said tube, and said open portion extending along an axis of said outer member; and an engagement retaining means for retaining an engagement between said inner cylinder and said outer member without any displacement therebetween in a rotational direction when said closed end portion of said tube is retained by said inner cylinder, wherein said engagement retaining means includes alternate radial projections and grooves, and a lock lever supported at one end of said outer member for engaging desired ones of said radial projections and grooves, wherein said lock lever is pressed downwardly to engage said grooves.

2. The tube squeezer of claim 1, wherein said engagement retaining means includes a disc-shaped plate fixedly mounted on one end of said inner cylinder.

3. The tube squeezer of claim 2, wherein said disc-shaped plate has said alternate radial projections and grooves.

4. The tube squeezer of claim 3, wherein said outer member is substantially in the form of a semicylindrical shape.

5. The tube squeeze of claim 3, wherein said lock lever is integrally formed with said outer member and made of resilient material.

* * * * *